United States Patent [19]

Takahashi et al.

[11] 4,445,946

[45] May 1, 1984

[54] HIGH STRENGTH COLD ROLLED STEEL STRIP HAVING AN EXCELLENT DEEP DRAWABILITY

[75] Inventors: Nobuyuki Takahashi; Masaaki Shibata; Yoshikuni Furuno, all of Kitakyushu, Japan

[73] Assignee: Nippon Steel Corporation, Tokyo, Japan

[21] Appl. No.: 296,474

[22] Filed: Aug. 26, 1981

[30] Foreign Application Priority Data

Aug. 27, 1980 [JP] Japan ..... 55-117028

[51] Int. Cl.[3] ..... C21D 8/04; C22C 38/14; C22C 38/28

[52] U.S. Cl. ..... 148/36; 75/123 D; 75/123 M; 75/126 D; 148/12 C

[58] Field of Search ..... 75/123 M, 126 D, 123 D, 75/126 K; 148/12 C, 12 D, 36

[56] References Cited

U.S. PATENT DOCUMENTS 3,368,886 2/1968 Mota et al. ..... 148/36

FOREIGN PATENT DOCUMENTS 55-24927 2/1980 Japan ..... 75/123 M
55-24952 2/1980 Japan ..... 148/12 C
55-73824 6/1980 Japan ..... 148/12 C
55-73825 6/1980 Japan ..... 75/126 D

OTHER PUBLICATIONS

Shimizu, "A Study Concerning the Development of a Super Drawable Cold Rolled Steel Strip", Doctoral Thesis, Kyoto University, Japan, Jun. 10, 1978, pp. 131, 158 and 159.

Brun et al., *Metallurgy of Continuous-Annealed Sheet Steel,* AIME, New York 1982, pp. 173–195.

*Primary Examiner*—Peter K. Skiff
*Attorney, Agent, or Firm*—Kenyon & Kenyon

[57] ABSTRACT

A high strength cold rolled steel strip having an excellent deep drawability comprises 0.005% by weight or less of C, 0.5% by weight or less of Si, 0.9% by weight or less of Mn, 0.05 to 0.12% by weight of P, 0.02 to 0.2% by weight of Al, 0.16% by weight or less of Ti, optionally, 1% by weight or less of Cr, and the balance consisting of Fe, the relationship (I):

$$Ti(\%)/C(\%) \geqq 4 \quad \text{(I)}$$

being satisfied, and is characterized in that the relationship (II):

$$P(\%) \times Ti(\%) \leqq 0.01 \quad \text{(II)}$$

is also satisfied.

5 Claims, No Drawings

HIGH STRENGTH COLD ROLLED STEEL STRIP HAVING AN EXCELLENT DEEP DRAWABILITY

FIELD OF THE INVENTION

The present invention relates to a high strength cold rolled steel strip having an excellent deep drawability, and useful for various types of surface coated steel strips.

BACKGROUND OF THE INVENTION

In recent years, in order to enhance the safety and durability of motor vehicles and to reduce the fuel consumption of vehicles, it has become very necessary to use a high strength cold rolled steel strip, especially, galvanized, having a tensile strength of from 35 to 50 $Kg/mm^2$, as inner and outer panels of motor vehicles. In order to apply the galvanized steel strip to the above-mentioned uses, it is indispensable that the steel strip exhibits not only a high tensile strength but also a superior deep drawability which allows the steel strip to resist to a severe press-forming procedure.

Generally, the hot galvanized steel strip is produced by using a continuous galvanizing line wherein the steel strip is subjected to an in-line annealing, for example, the Senzimir type galvanizing line. In the case of the in-line annealing, the annealing time is short and the heating and cooling rates are high. Therefore, it is known that the production of a high strength galvanized steel strip having excellent deep drawability is difficult. Usually, a high strength galvanized steel strip is produced for a structural use, containing, a strengthening alloying component consisting of carbon and manganese. However, this type of high strength galvanized steel strip exhibits a poor deep drawability and, therefore, is unsuitable as inner or outer panels for motor vehicles which must be subjected to a deep drawing procedure.

In most recent years, as a method for producing a high strength deep drawing galvanized steel strip, a rephosphorized Al-killed steel is box-annealed for a long period of time, and then, processed by the in-line annealing type continuous galvanizing line. However, in the above-mentioned method, the advantage of the in-line annealing procedure cannot be obtained and the product becomes very expensive.

Japanese Patent Application Publication (KOKOKU) Nos. 42-12348 (1967) and 44-18066 (1969) disclose a cold rolled steel strip having excellent deep drawability, respectively. These steels are very low carbon steels with titanium added.

Also, it is known that phosphorus is a cheap strengthening alloying element for steel strips.

However, hitherto it is believed that the addition of phosphorus to the titanium-containing very low carbon steel causes the recrystallization temperature to rise and the deep drawability to lower, and, therefore, should be avoided.

Under the above-mentioned circumstances, it was strongly desired by the industry to provide a new type of high strength cold rolled steel strip which exhibits a superior deep drawability.

SUMMARY OF THE INVENTION

An object of the present invention is to provide a high strength cold rolled steel strip having a superior deep drawability.

Another object of the present invention is to provide a high strength surface coated steel strip, for example, a galvanising steel strip having excellent deep drawability.

The above-mentioned objects can be attained by the cold rolled steel strip of the present invention which comprises 0.005% by weight or less of carbon;
0.5% by weight or less of silicon;
0.9% by weight or less of manganese;
0.05 to 0.12% by weight of phosphorus;
0.02 to 0.2% by weight of aluminium;
0.16% by weight or less of titanium;
and the balance consisting of iron and unavoidable impurities, and satisfies the relationship (I):

$$(\text{Content (\%) of titanium})/(\text{Content (\%) of carbon}) \geqq 4$$

and which steel strip is characterized by satisfying the relationship (II):

$$(\text{Content (\%) of phosphorous}) \times (\text{Content (\%) of titanium}) \leqq 0.01. \quad \text{(II)}$$

The steel strip of the present invention optionally contains 1.0% by weight or less of chromium.

DETAILED DESCRIPTION OF THE INVENTION

In conventional cold rolled steel strips containing C, Si, Mn, Al, Ti and Fe, it has been believed hitherto that the addition of phophorus to the Ti-containing very low carbon steel strip results in an undesirable elevated recrystallization temperature and decreased deep drawability of the resultant Ti-P-containing steel strip.

However, in the cold rolled strip of the present invention, it was found that the above-mentioned disadvantages could be eliminated by adjusting the contents (%) of phosphorus and titanium so as to satisfy the relationship (II):

$$(\text{Content (\%) of P}) \times (\text{Content (\%) of Ti}) \leqq 0.01 \quad \text{(II)}$$

It is preferable that the product of P(%) with Ti(%) is 0.008 or less, more preferably, in the range of from 0.002 to 0.007. The reason why the relationship (II) is effective for imparting both an excellent mechanical strength and deep drawability to the P-Ti-containing steel strip, is not completely clear. However, it is assumed that when the contents (%) of phosphorus and titanium are adjusted so as to satisfy the relationship (II), phosphorus is solid-dissolved into the degassing titanium-containing steel, and the resultant solid solution is effective for enhancing the tensile strength of the steel while maintaining the deep drawability thereof at a high level. However, if the product of the content (%) of phosphorus with the content (%) of titanium is larger than 0.01, a special phosphorus compound, FeTiP, is precipitated while the steel strip is hot rolled or annealed. Also, the phosphorus compound causes the deep drawability of the resultant steel to be significantly deteriorated and the recrystallization temperature of the steel strip to be undesirably increased. In extreme cases, the phosphorus compound hinders the recrystallization of the steel strip in the annealing procedure.

The reasons for the limitation in content of the alloying elements in the steel strip of the present invention will be illustrated below.

The content of carbon should be 0.005% by weight or less, preferably, in the range of from 0.001 to 0.004% by weight. An excessive amount of carbon causes the content of the compound TiC to increase to such an extent that the resultant steel strip exhibits an unsatisfactory deep drawability. Also, it becomes necessary to add an increased amount of titanium to the steel strip. This results in an economical disadvantage.

The content of silicon should be less than 0.5% by weight, preferably, less than 0.08% by weight. Silicon is effective as a strengthener for the steel strip. However, an excessively large content of silicon results in an unsatisfactory surface chemical processability. That is, the surface of the steel strip exhibits a poor bonding property to surface coating layers, for example, galvanized zinc, aluminum or other alloy layers. Also, the excessive amount of silicon cooperates with phosphorus so as to make the resultant steel strip brittle and the secondary workability of the steel strip poor.

The content of manganese should be 0.9% by weight or less, preferably, from 0.4 to 0.8% by weight. Manganese is effective for preventing thermal cracks in the steel strip due to the presence of a sulphur impurity therein, and for enhancing the tensile strength of the steel strip. However, an increase of the content of manganese to more than 0.9% by weight, causes the degassing procedure of the resultant steel to be difficult and results in a high cost of the steel strip.

The content of phosphorus should be in the range of from 0.05 to 0.12% by weight, preferably, from 0.06 to 0.1% by weight.

Phosphorus is a most important component for the steel strip of the present invention and serves as a main strengthener. When the content of phosphorus is less than 0.05% by weight, substantially no strengthening effect is imparted to the resultant steel strip. An increase in the phosphorous content to more than 0.12% by weight causes the resultant steel strip to be brittle.

The content of aluminium should be in the range of from 0.02 to 0.2% by weight, preferably, from 0.02 to 0.05% by weight. Aluminum is effective as a deoxidizing alloying element. If the content of aluminum is less than 0.02% by weight, the deoxidation effect becomes unstable and unsatisfactory. An excessive content of aluminum, more than 0.20% by weight, exhibits no contribution in increasing the deoxidation effect of aluminum.

The content of titanium should be 0.16% by weight or less, preferably, from 0.04 to 0.13% by weight.

Titanium is effective for remarkably enhancing the deep drawability of the steel strip as long as the relationship (I): $Ti(\%)/C(\%) \geqq 4$ is satisfied, as is described in Japanese Patent Application Publication No. 42-12348 or 44-18066. However, in order to ensure that titanium exhibits its deep drawability-enhancing effect in the steel strip of the present invention, the relationship (II): $P(\%) \times Ti(\%) \leqq 0.01$ should be satisfied, as described hereinbefore, because the steel strip of the present invention contains a relatively large amount of phosphorus. If the content of titanium is more than 0.16% by weight, it is practically impossible to satisfy the relationship (II), in relation to the range of the phosphorus content according to the present invention.

Chromium in an amount of 1% by weight or less, preferably, from 0.2 to 0.8% by weight may be optionally added in order to attain an enhanced tensile strength while the desirable effects of the present invention are retained. An increase in the chromium content to more than 1% by weight causes the resultant steel strip to exhibit a deteriorated deep drawability.

The cold rolled steel strip having the above mentioned composition of the present invention can be produced in the following manner.

The starting materials prepared so as to provide the above mentioned composition are melted in a melting furnace such as an electric furnace and a converter, and then, the melt is subjected to a vacuum degassing treatment. The degassed melt is subjected to an ingot-making slabbing procedure or a continuous casting procedure, whereby a steel slab is obtained. The steel slab is then hot rolled and cold rolled. Thereafter, the resultant cold rolled steel strip is annealed by a continuous annealing method. Otherwise, the cold rolled steel strip is directly subjected to a conventional continuous galvanizing process line such as the Senzimir process line, in which an in-line annealing procedure is applied to the steel strip, and, if necessary, further subjected to an alloying treatment procedure so that a zinc-coated steel strip is obtained.

It is to be understood that the cold rolled steel strip of the present invention may be subjected to a surface coating procedure, for example, an aluminum-plating procedure or a terne metal-plating procedure, and, further, to a chemical treatment, as described hereinabove.

The present invention will be illustrated by the examples set forth below, which are provided for the purpose of illustration and should not be interpreted as in any way limiting the scope of the present invention.

EXAMPLES 1 TO 4 AND COMPARATIVE EXAMPLES 1 TO 5

In each of the Examples 1 to 4 and Comparative Examples 1 to 5, a starting material having the composition as indicated in Table 1 was melted and the melt was subjected to a vacuum degassing treatment. The degassed melt was subjected to a continuous casting procedure so as to produce a steel slab. The steel slab was reheated to a temperature of 1100° C. and hot rolled. After pickling procedure was applied to the hot rolled steel strip, a cold rolling procedure was applied to the pickled steel strip at a reduction of 70% to produce a cold rolled steel strip having a thickness of 0.8 mm. The cold rolled steel strip was divided into two pieces. One piece was passed through a continuous annealing apparatus wherein it was annealed at a temperature of 775° C. for 60 seconds. The other piece was passed through the Senzimir type continuous galvanizing apparatus wherein an in-line annealing procedure was applied to the strip at a temperature of 775° C. for 50 seconds. Thus, a cold rolled steel strip product and a galvanized steel strip product was obtained. A half portion of the galvanized steel strip was further subjected to an alloying treatment at a temperature of 550° C. for 10 seconds. The mechanical properties of the steel strip are shown in Table 2. In Table 2, a tensile strength (TS) of 35 kg/mm or more and an average plastic strain ratio $(\bar{r})$ of 1.5 or more of the steel strip are deemed to be satisfactory providing high stensile strength and excellent deep drawability for the present invention, respectively.

It is apparent from the results indicated in Table 2 that the steel strips of the present invention exhibit a higher tensile strength and a more excellent deep drawability, as compared with the comparative steel strips.

As described above, the present invention can stably provide, at a relatively low cost, a galvanized steel strip having a high tensile strength and an excellent deep drawability, for which steel strip new industrial demand is increasing. Therefore, the present invention is very useful for industrial purposes.

TABLE 1

| Example No. | Component (%) C | Si | Mn | P | Al | Cr | Ti | Ti (%)/C (%) | P (%) × Ti (%) |
|---|---|---|---|---|---|---|---|---|---|
| Comparative Example 1 | 0.005 | 0.03 | 0.38 | 0.020 | 0.050 | — | 0.117 | 23.4 | 0.002 |
| Comparative Example 2 | 0.006 | 0.01 | 0.72 | 0.054 | 0.031 | — | 0.132 | 22.0 | 0.007 |
| Example 1 | 0.004 | 0.03 | 0.40 | 0.070 | 0.048 | — | 0.077 | 19.3 | 0.005 |
| Example 2 | 0.003 | 0.04 | 0.19 | 0.067 | 0.073 | 0.32 | 0.032 | 10.7 | 0.002 |
| Comparative Example 3 | 0.003 | 0.02 | 0.32 | 0.065 | 0.061 | — | 0.204 | 68.0 | 0.013 |
| Example 3 | 0.003 | 0.03 | 0.38 | 0.103 | 0.030 | 0.13 | 0.085 | 28.3 | 0.008 |
| Comparative Example 4 | 0.003 | 0.03 | 0.41 | 0.098 | 0.049 | — | 0.121 | 40.3 | 0.012 |
| Example 4 | 0.002 | 0.04 | 0.77 | 0.108 | 0.028 | 0.80 | 0.068 | 34.0 | 0.008 |
| Comparative Example 5 | 0.003 | 0.02 | 0.29 | 0.108 | 0.035 | — | 0.203 | 67.7 | 0.022 |

TABLE 2

| Example No. | Mechanical properties and deep drawability: Cold rolled steel strip Y Pkg/mm² | T SKg/mm² | El % | $\bar{r}$ | galvanized steel strip Y PKg/mm² | T SKg/mm² | El % | $\bar{r}$ | galvanized, alloying-treated steel strip Y PKg/mm² | T SKg/mm² | El % | $\bar{r}$ |
|---|---|---|---|---|---|---|---|---|---|---|---|---|
| Comparative Example 1 | 17.0 | 31.8 | 44.6 | 1.75 | 17.5 | 32.9 | 43.8 | 1.74 | 17.8 | 33.1 | 42.9 | 1.70 |
| Comparative Example 2 | 20.5 | 37.2 | 40.2 | 1.43 | 20.3 | 37.2 | 39.3 | 1.41 | 21.0 | 37.1 | 39.2 | 1.45 |
| Example 1 | 20.6 | 37.9 | 42.1 | 1.88 | 21.1 | 38.3 | 41.4 | 1.90 | 21.3 | 38.6 | 41.1 | 1.83 |
| Example 2 | 21.0 | 38.0 | 41.8 | 1.83 | 21.2 | 38.5 | 41.5 | 1.81 | 21.4 | 39.1 | 40.8 | 1.76 |
| Comparative Example 3 | 22.6 | 41.4 | 36.5 | 1.45 | 22.8 | 41.3 | 36.0 | 1.46 | 22.8 | 41.5 | 36.1 | 1.41 |
| Example 3 | 23.1 | 41.9 | 38.0 | 1.75 | 23.0 | 42.1 | 37.6 | 1.72 | 23.4 | 42.6 | 37.3 | 1.69 |
| Comparative Example 4 | 23.9 | 42.5 | 35.1 | 1.42 | 24.1 | 42.8 | 34.7 | 1.45 | 24.0 | 42.8 | 34.2 | 1.44 |
| Example 4 | 24.5 | 45.0 | 35.0 | 1.69 | 25.7 | 47.1 | 34.3 | 1.66 | 26.0 | 46.4 | 34.5 | 1.62 |
| Comparative Example 5 | Incomplete recrystallization occurred | | | | Incomplete recrystallization occurred | | | | Incomplete recrystallization occurred | | | |

Note:
Y P: Yield point
T S: Tensile strength
El: Ultimate elongation
$\bar{r}$ value: Average plastic strain ratio

We claim:

1. A high strength cold rolled, continuously annealed steel strip having an excellent deep drawability, consisting essentially of less than 0.005% by weight of carbon;
0.5% by weight or less of silicon;
0.19% to 0.90% by weight of manganese;
0.05% to 0.12% by weight of phosphorus;
0.02% to 0.2% by weight of aluminum;
0.16% by weight or less of titanium;
and the balance of iron with unavoidable impurities, and
satisfying the relationships (I) and (II):

(Content (%) of titanium)/Content (%) of carbon)≧4 (I)

and (Content (%) of phosphorus)×(Content (%) of titanium)≦0.01 (II), and wherein said steel strip has both a tensile strength of 35 kg/mm² or greater and an average plastic strain ratio $\bar{r}$ of 1.62 or greater.

2. The high strength cold rolled, continuously annealed steel strip according to claim 1 which further comprises 1% by weight or less of chromium.

3. The high strength cold rolled, continuously annealed steel strip according to claim 2 wherein the range of chromium is 0.2% to 0.8% by weight.

4. The high strength cold rolled, continuously annealed steel strip according to claim 1 wherein the range of carbon is 0.001% to 0.004% by weight.

5. The high strength cold rolled, continuously annealed steel strip according to claim 2 wherein the range of carbon is 0.001% to 0.004% by weight.

* * * * *